US011564040B2

(12) United States Patent
Gao et al.

(10) Patent No.: US 11,564,040 B2
(45) Date of Patent: Jan. 24, 2023

(54) SPEAKER MODULE

(71) Applicant: Goertek Inc., Shandong (CN)

(72) Inventors: Yuan Gao, Shandong (CN); Chengwei Li, Shandong (CN); Zhenjun Li, Shandong (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 17/280,549

(22) PCT Filed: Dec. 20, 2018

(86) PCT No.: PCT/CN2018/122260
§ 371 (c)(1),
(2) Date: Mar. 26, 2021

(87) PCT Pub. No.: WO2020/062632
PCT Pub. Date: Apr. 2, 2020

(65) Prior Publication Data

US 2022/0038823 A1 Feb. 3, 2022

(30) Foreign Application Priority Data

Sep. 28, 2018 (CN) ..... 201821600233.5

(51) Int. Cl.
*H04R 1/02* (2006.01)
*H04R 9/06* (2006.01)
(Continued)

(52) U.S. Cl.
CPC ..... *H04R 9/06* (2013.01); *H04R 1/021* (2013.01); *H04R 1/023* (2013.01); *H04R 1/288* (2013.01);
(Continued)

(58) Field of Classification Search
CPC ..... H04R 1/021; H04R 1/023; H04R 1/2811; H04R 1/288; H04R 9/02; H04R 9/06; H04R 2499/11; H04R 2499/15
See application file for complete search history.

(56) References Cited

U.S. PATENT DOCUMENTS 7,953,461 B2 * 5/2011 Fukazawa ..... H04R 1/225 455/575.1
9,838,765 B1 12/2017 Li et al.
(Continued)

FOREIGN PATENT DOCUMENTS

CN 206948596 U 1/2018
CN 207099286 U 3/2018
(Continued)

*Primary Examiner* — Huyen D Le
(74) *Attorney, Agent, or Firm* — Baker Botts, LLP

(57) ABSTRACT

The present disclosure discloses a speaker module, comprising a module housing and a speaker unit disposed in the module housing, wherein the speaker unit divides a cavity enclosed by the module housing into a front acoustic cavity and a rear acoustic cavity, the module housing is further provided with an air-permeable insulation assembly which divides the rear acoustic cavity into a first chamber and a second chamber, and the second chamber is filled with a sound-absorbing material, and wherein the air-permeable insulation assembly comprises a support frame and a mesh cloth adhered and fixed to the support frame by means of a back adhesive. The present disclosure can be used to prevent the problems of mesh breakage and mesh deviation that are likely to occur when the mesh cloth is being installed at the air-permeable insulation assembly, thereby improving the production yield of the air-permeable insulation assembly.

5 Claims, 3 Drawing Sheets

(51) Int. Cl.
*H04R 1/28* (2006.01)
*H04R 9/02* (2006.01)

(52) U.S. Cl.
CPC ..... *H04R 1/2811* (2013.01); *H04R 9/02* (2013.01); *H04R 2499/11* (2013.01); *H04R 2499/15* (2013.01)

(56) References Cited

U.S. PATENT DOCUMENTS

| | | | | |
|---|---|---|---|---|
| 2010/0254558 | A1* | 10/2010 | Meyer | H04R 1/347<br>381/345 |
| 2018/0132020 | A1* | 5/2018 | Seo | H04R 1/023 |
| 2018/0132035 | A1* | 5/2018 | Cao | H04R 1/288 |

FOREIGN PATENT DOCUMENTS

| | | | | |
|---|---|---|---|---|
| CN | 207652649 | U | 7/2018 | |
| CN | 207720341 | U | 8/2018 | |
| CN | 207869365 | U | 9/2018 | |
| WO | WO-2016165355 | A1 * | 10/2016 | H04R 1/02 |

* cited by examiner

SPEAKER MODULE

CROSS-REFERENCE TO RELATED APPLICATIONS

This application is a National Stage of International Application No. PCT/CN2018/122260, filed on Dec. 20, 2018, which claims priority to Chinese Patent Application No. 201821600233.5, filed on Sep. 28, 2018, both of which are hereby incorporated by reference in their entireties.

TECHNICAL FIELD

The present disclosure relates to the technical field of acoustic-electric conversion. More specifically, it relates to a speaker module.

BACKGROUND

The prior speaker module usually includes a module housing and a speaker unit disposed in the module housing. The speaker unit divides the cavity enclosed by the module housing into a front acoustic cavity and a rear acoustic cavity. The speaker unit includes a vibration assembly and a magnetic circuit assembly. The vibration assembly includes a diaphragm and a voice coil that being fixed together, and after the current is input into the voice coil, it vibrates under the ampere force of the magnetic field formed by the magnetic circuit assembly, and in turn drives the diaphragm to vibrate and produce the sound. In order to adjust the acoustic performance of the speaker, sound-absorbing materials are arranged in the rear acoustic cavity. The current speaker module usually uses an air-permeable insulation assembly to divide the rear acoustic cavity into a first cavity and a second cavity. The second cavity is filled with sound-absorbing material. The air-permeable insulation assembly has an air-permeability function, but also prevents the sound-absorbing material from entering into the speaker unit.

The current air-permeable insulation assembly are usually formed by injecting the mesh cloth on the support frame. With the development of acoustic products, the air-permeable insulation assembly often need to be set in an irregular shape. It is difficult to form a mold to inject the irregularly shaped mesh cloth during the molding process. In addition, when the mesh cloth is injected, it is also prone to mesh breakage, mesh deviation or the like, resulting in a low injection yield of the mesh cloth.

SUMMARY

The purpose of this disclosure is to provide a speaker module which prevents the problems of mesh breakage and mesh deviation that are likely to occur when the mesh cloth is being installed at the air-permeable insulation assembly, thereby improving the production yield of the air-permeable insulation assembly.

In order to achieve the above purpose, the disclosure adopts the following technical solutions:

The disclosure provides a speaker module, comprising a module housing and a speaker unit disposed in the module housing, wherein the speaker unit divides a cavity enclosed by the module housing into a front acoustic cavity and a rear acoustic cavity, the module housing is further provided with an air-permeable insulation assembly which divides the rear acoustic cavity into a first chamber and a second chamber, and the second chamber is filled with a sound-absorbing material, and wherein the air-permeable insulation assembly comprises a support frame and a mesh cloth adhered and fixed to the support frame by means of a back adhesive.

Preferably, the module housing forming the rear acoustic cavity is formed with a clamping wall extending from a bottom surface to a top surface of the module housing, and the air-permeable insulation assembly is inserted into the clamping wall, and together with the clamping wall separates the rear acoustic cavity into a first cavity and a second cavity.

Preferably, a first groove for accommodating the air-permeable insulation assembly is formed on the clamping wall, an outer surface of the support frame close to the first groove is further provided with an elastic pad, and the elastic pad is compressed when the air-permeable insulation assembly is inserted into the clamping wall to seal the air-permeable insulation assembly and the clamping wall.

Preferably, a first groove for accommodating the air-permeable insulation assembly is formed on the clamping wall, an elastic pad is provided in the first groove, and the elastic pad is compressed when the air-permeable insulation assembly is inserted into the clamping wall to seal the air-permeable insulation assembly and the clamping wall.

Preferably, the module housing comprises an upper module housing, a middle module housing and a lower module housing, the speaker unit and the upper module housing enclose the front sound cavity, the speaker unit and the upper module housing, the middle module housing and the lower module housing enclose the rear acoustic cavity.

Preferably, the middle module housing comprises a bottom wall and a side wall extending perpendicular to the bottom wall, an opening is formed on a side of the side wall close to the speaker unit, and the clamping wall comprises at least a first clamping wall and a second clamping wall respectively formed on the side wall on both sides of the opening, and one end of the first clamping wall and the second clamping wall is connected to the bottom wall.

Preferably, the clamping wall further comprises a third clamping wall formed on the bottom wall and connecting the first clamping wall and the second clamping wall.

Preferably, the air-permeable insulation assembly and the lower module housing are sealed with glue.

Preferably, the clamping wall further comprises a fourth clamping wall formed on the lower module housing and corresponding to the air-permeable insulation assembly, and a second groove for inserting the air-permeable insulation assembly is formed on the fourth clamping wall.

Preferably, the air-permeable insulation assembly and the module housing are integrally injection molded; wherein the back adhesive is a double-sided adhesive.

The beneficial effects provided by this disclosure are as follows:

The mesh cloth in the air-permeable insulation assembly of the speaker module of this disclosure is fixed on the support frame by means of a back adhesive. Since the back adhesive is easy to cut, double-sided adhesive with irregular shapes corresponding to the outline of the support frame may be made. The support frame is adhered and fixed with the back adhesive, which may avoid the problem of mesh deviation or mesh breakage when the mesh cloth is fixed and may also adapt to the assembly of irregular-shaped mesh cloth and support frame.

BRIEF DESCRIPTION OF THE DRAWINGS

The specific embodiments of the disclosure will be described in further detail below in conjunction with the drawings.

DRAWING REFERENCE SIGNS

Figure 1:
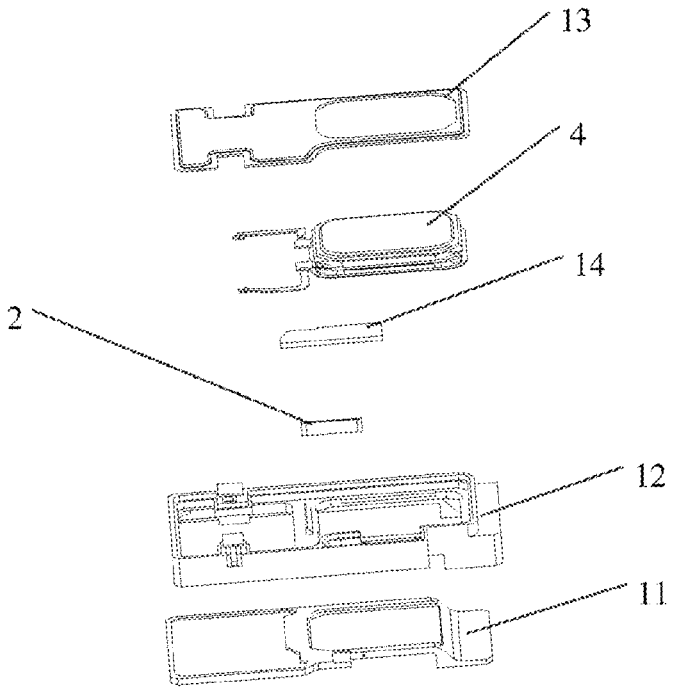
FIG. 1 shows an exploded schematic diagram of a specific embodiment of a speaker module according to the disclosure.
Figure 2:
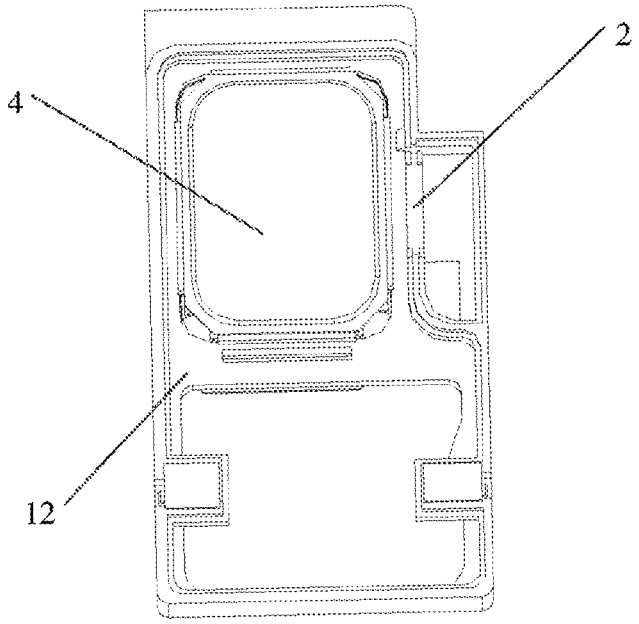
FIG. 2 shows an internal schematic diagram of a specific embodiment of a speaker module according to the disclosure.
Figure 3:
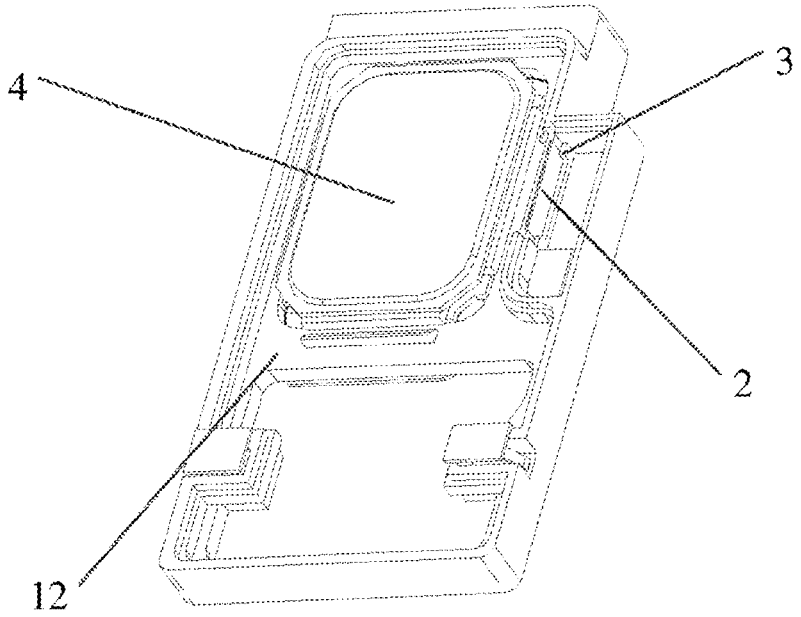
FIG. 3 shows another internal schematic diagram of a specific embodiment of a speaker module according to the disclosure.
Figure 4:
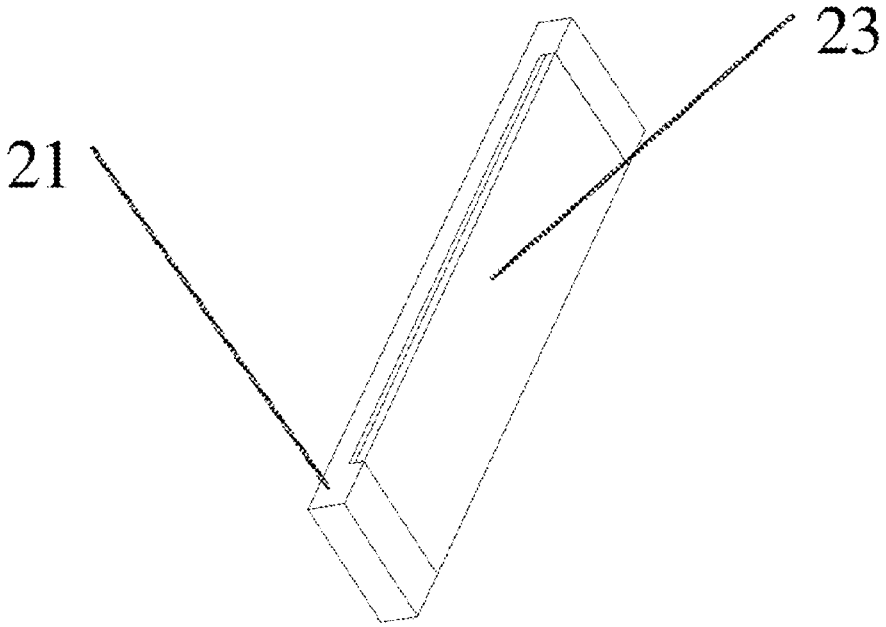
FIG. 4 shows a schematic diagram of an air-permeable insulation assembly in a specific embodiment of a speaker module according to the disclosure.
Figure 5:
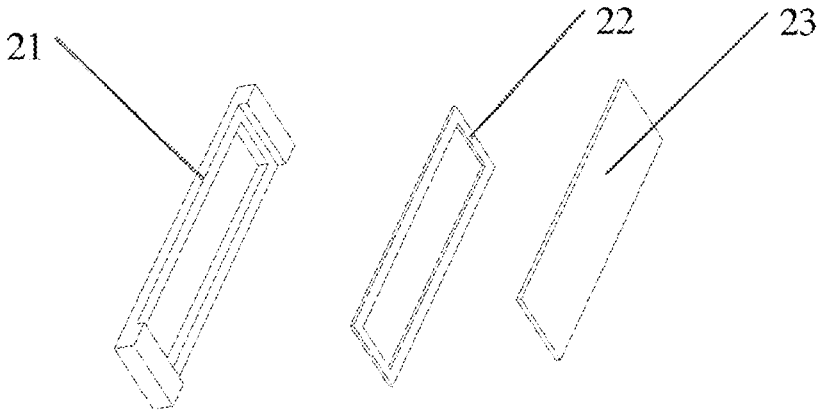
FIG. 5 shows an exploded schematic diagram of an air-permeable insulation assembly in a specific embodiment of a speaker module according to the disclosure.

11—upper module housing, 12—middle module housing, 13—lower module housing, 14—small lower housing, 2—air-permeable insulation assembly, 21—support frame, 22—double-sided adhesive, 23—mesh cloth, 3—clamping wall, 4—speaker unit.

DETAILED DESCRIPTION

In order to explain the disclosure more clearly, the disclosure will be further explained below in conjunction with preferred embodiments and drawings. Similar components in the drawings are denoted by the same reference numeral. Those skilled in the art should understand that the contents described below are illustrative rather than restrictive, and should not limit the scope of protection of the disclosure.

FIG. 1 shows a specific embodiment of a speaker module. In this embodiment, the speaker module comprises a module housing and a speaker unit 4 disposed in the module housing. The speaker unit 4 divides the cavity enclosed by the module housing into a front acoustic cavity and a rear acoustic cavity. The module housing is provided with an insulation assembly that divides the rear acoustic cavity into a first chamber and a second chamber. The second chamber is filled with sound-absorbing material. The insulation assembly comprises a support frame 21 and a mesh cloth 23 adhered and fixed to the support frame 21 by means of a back adhesive. In a preferred embodiment, the back adhesive is a double-sided adhesive 22. The mesh cloth 23 in the air-permeable insulation assembly 2 is fixed on the support frame 21 by means of the double-sided adhesive 22. Since the double-sided adhesive 22 is easy to cut, the double-sided adhesive 22 with irregular shapes corresponding to the outline of the support frame 21 may be made. The support frame 21 is adhered and fixed with the double-sided adhesive 22, which may avoid the problem of mesh deviation or mesh breakage when the mesh cloth 23 is fixed and may also adapt to the assembly of irregular-shaped mesh cloth 23 and support frame.

In this embodiment, the module housing comprises an upper module housing 11, a middle module housing 12 and a lower module housing 13. The upper module housing 11, the middle module housing 12 and the lower module housing 13 together form a cavity for accommodating the speaker unit 4. Specifically, the speaker unit 4 and the upper module housing 11 enclose the front sound cavity for the sound generating, the speaker unit 4 and the upper module housing 11, the middle module housing 12 and the lower module housing 13 enclose the rear acoustic cavity. The rear acoustic cavity is used to adjust the sound quality of the sound generator and improve the low-frequency acoustic performance of the speaker. A part of the upper module housing 11 is used to form a front acoustic cavity, and another part is used to form a rear acoustic cavity. The lower module housing 13 comprises a small lower housing 14, the small lower housing 14 being located in a sound-absorbing material area for filling and sealing the sound-absorbing material.

Preferably, in this embodiment, the module housing of the rear acoustic cavity is formed with a clamping wall 3 extending from a bottom surface to a top surface of the module housing, and the air-permeable insulation assembly is inserted into the clamping wall 3, and together with the clamping wall 3 separates the rear acoustic cavity into a first cavity and a second cavity. The air-permeable insulation assembly 2 may allow the air flow communication between the first cavity and the second cavity. The diameter of the air-permeable hole of the air-permeable insulation assembly 2 should be smaller than the diameter of the sound-absorbing material particle to prevent the sound-absorbing material from passing through the air-permeable insulation assembly 2 into the speaker unit 4. More preferably, the clamping wall 3 may extend to the top surface of the module housing to improve the fixing effect of the air-permeable insulation assembly 2. Those skilled in the art should understand that in practical applications, in the embodiments of the disclosure, the module housing comprises, but is not limited to, the structure with three-part housings, that is, the module housing may be composed of two-part housings, that is an upper module housing and a lower module housing. In this embodiment, the clamping wall may be arranged on the lower module housing. Specifically, the lower module housing is formed with a clamping wall extending from a bottom surface to a top surface of the lower module housing, which will not be repeated in this disclosure.

In a preferred embodiment, the middle module housing 12 comprises a bottom wall and a side wall extending perpendicular to the bottom wall from the edge of the bottom wall, and an opening is formed on a side of the side wall close to the speaker unit 4. The clamping wall 3 comprises at least a first clamping wall and a second clamping wall respectively formed on the side wall on both sides of the opening. One end of the first clamping wall and the second clamping wall is connected to the bottom wall. The first clamping wall and the second clamping wall define and fix the two sides of the air-permeable insulation assembly 2 to maintain the fixing stability of the air-permeable insulation assembly 2 and together with the air-permeable insulation assembly 2, separate the rear acoustic cavity into the first cavity and the second cavity.

In another embodiment, the clamping wall 3 may further comprise a third clamping wall formed on the bottom wall for inserting the air-permeable insulation assembly 2, the third clamping wall, the first clamping wall and the second clamping wall together play a role of limiting and fixing the air-permeable insulation assembly 2 to improve the fixing stability of the air-permeable insulation assembly 2. More preferably, the third clamping wall may be connected to at least one of the first clamping wall and the second clamping wall.

In another embodiment, the clamping wall 3 may further comprises a fourth clamping wall 3 formed on the lower module housing 13 and corresponding to the insulation assembly, and the fourth clamping wall 3 is formed with a second groove for inserting the air-permeable insulation assembly 2. After the air-permeable insulation assembly 2 is installed on the clamping wall 3 of the middle module housing 12 by inserting, the lower module housing 13 may be fixed and sealed with the air-permeable insulation assembly 2 through the second groove, thereby further fixing the air-permeable insulation assembly 2. In another embodiment, the insulation assembly may also be sealed with the lower module housing 13 by applying glue.

In one embodiment, the air-permeable insulation assembly 2 may be installed on the middle module housing 12 by inserting after injection molding the middle module housing 12. In another embodiment, the air-permeable insulation assembly 2 may also be integrally injection molded with the module housing after the assembly.

In a preferred embodiment, the clamping wall 3 is formed with a first groove for accommodating the air-permeable insulation assembly 2. In order to further seal the air-permeable insulation assembly 2 and the clamping wall 3, an outer surface of the support frame 21 close to the first groove is further provided with an elastic pad, and the elastic pad is compressed when the air-permeable insulation assembly 2 is inserted into the clamping wall 3 to seal the air-permeable insulation assembly 2 and the clamping wall 3. In another preferred embodiment, likewise, an elastic pad may also be provided in the first groove, and the elastic pad is compressed when the insulation assembly is inserted into the clamping wall 3 to seal the insulation assembly and the clamping wall 3.

Obviously, the above-mentioned embodiments of this disclosure are merely examples to clearly illustrate this disclosure, rather than limiting the implementation of this disclosure. For those of ordinary skill in the art, other changes or modifications in different forms may be made on the basis of the above description. It is impossible to list all the implementations here. Any obvious changes or modifications derived from the technical solution of this disclosure are still in the protection scope of this disclosure.

The invention claimed is:

1. A speaker module, comprising a module housing and a speaker unit disposed in the module housing, wherein the speaker unit divides a cavity enclosed by the module housing into a front acoustic cavity and a rear acoustic cavity, the module housing is further provided with an air-permeable insulation assembly which divides the rear acoustic cavity into a first chamber and a second chamber, and the second chamber is filled with a sound-absorbing material, and wherein the air-permeable insulation assembly comprises a support frame and a mesh cloth adhered and fixed to the support frame by a back adhesive, and wherein a first groove for accommodating the air-permeable insulation assembly is formed on a clamping wall extending from a bottom surface to a top surface of the module housing, an elastic pad is provided in the first groove, and the elastic pad is adapted for compression when the air-permeable insulation assembly is inserted into the clamping wall to seal the air-permeable insulation assembly and the clamping wall.

2. The speaker module according to claim 1, wherein the module housing forming the rear acoustic cavity is formed with the clamping wall, and the air-permeable insulation assembly is inserted into the clamping wall, and together with the clamping wall separates the rear acoustic cavity into a first cavity and a second cavity.

3. The speaker module according to claim 2, wherein the module housing comprises an upper module housing, a middle module housing and a lower module housing, the speaker unit and the upper module housing enclose the front sound cavity, the speaker unit and the upper module housing, the middle module housing and the lower module housing enclose the rear acoustic cavity.

4. The speaker module according to claim 3, wherein the air-permeable insulation assembly and the lower module housing are sealed with glue.

5. The speaker module according to claim 1, wherein the air-permeable insulation assembly and the module housing are integrally injection molded; wherein the back adhesive is a double-sided adhesive.

* * * * *